US005974700A

United States Patent [19]

Kelly

[11] Patent Number: 5,974,700

[45] Date of Patent: Nov. 2, 1999

[54] SHOE CLEATS

[75] Inventor: Paul Andrew Kelly, Atherstone, United Kingdom

[73] Assignee: Trisport Limited, Staffordshire, United Kingdom

[21] Appl. No.: 09/138,110

[22] Filed: Aug. 21, 1998

Related U.S. Application Data

[60] Provisional application No. 60/057,967, Sep. 5, 1997.

[30] Foreign Application Priority Data

| | | | |
|---|---|---|---|
| Aug. 21, 1997 | [GB] | United Kingdom | 9717618 |
| Jul. 7, 1998 | [GB] | United Kingdom | 9814586 |

[51] Int. Cl.[6] ..... A43C 15/16

[52] U.S. Cl. ..... 36/134; 36/67 D

[58] Field of Search ..... 36/134, 67 D

[56] References Cited

U.S. PATENT DOCUMENTS

| | | | |
|---|---|---|---|
| 2,223,794 | 12/1940 | Pierce et al. . | |
| 2,624,128 | 1/1953 | Phillips . | |
| 4,205,466 | 6/1980 | Collins | 36/67 |
| 4,587,748 | 5/1986 | Collins . | |
| 5,036,606 | 8/1991 | Erich et al. . | |
| 5,123,184 | 6/1992 | Ferrera . | |
| 5,321,901 | 6/1994 | Kelly . | |

FOREIGN PATENT DOCUMENTS

| | | |
|---|---|---|
| 0 342 232 | 2/1989 | European Pat. Off. . |
| 196 32 537 | 3/1997 | Germany . |
| 0 028 102 | 3/1980 | United Kingdom . |
| 2 238 098 | 5/1991 | United Kingdom . |
| WO 91/03182 | 3/1991 | WIPO . |
| WO 91/04685 | 4/1991 | WIPO . |
| WO 91/15131 | 10/1991 | WIPO . |

*Primary Examiner*—Ted Kavanaugh

*Attorney, Agent, or Firm*—Schweitzer Cornman Gross & Bondell LLP

[57] ABSTRACT

In a combination of shoe cleat and holder, a screw-threaded spigot (12) on the cleat is inserted with rotation into a complementary socket (18) of the holder, and has a ring of free-standing posts (34, 42) extending axially from the cleat and a ring of radially-projective teeth (26) on the holder, the rings being co-axial with the screw axis so that during at least later stages of insertion of the spigot (12) into the socket (18), on relative rotation of the rings, engagement of the teeth (26) with the posts (34, 42) causes the posts (34, 42) to deflect resiliently and engagement of the teeth (26) between the posts (34, 42) causes interengagement of the locking means.

6 Claims, 3 Drawing Sheets

SHOE CLEATS

This application claims priority of British Patent Application No. 9717618.4, filed Aug. 21, 1997, Provisional Application Ser. No. 60/057,967, filed Sep. 5, 1997, and British Patent Application No. 9814586.5, filed Jul. 7, 1998.

This invention is concerned with improvements in or relating to the securement of shoe cleats in shoe soles and heels.

It is well known for cleats to be secured, for example in the soles of golf shoes, by means of a screw-threaded spigot on the cleat which becomes engaged in a correspondingly threaded socket in the shoe sole. The socket is ordinarily provided by a separately formed receptacle which may be incorporated into a moulded sole, or may be secured within a composite sole structure comprising leather, EVA or other sheet material forming an outsole. Usually the cleats can be unscrewed for replacement when they become excessively worn or damaged.

Cleats secured in this manner may have a ground-piercing stud or spike (as described, for example, in GB-A-2 028 102) or other forms of ground-gripping elements (as described, for example, in EP-A-0 342 232) projecting from an underside of a disc-like flange body; the spigot projects from an upper side of the flange body.

Most known forms of screw-threaded cleat utilise a single start thread rather than a multi-start thread. In addition to being the simplest thread form, a single start thread provides the advantage over a multi-start thread of offering greater resistance to unscrewing after the cleat has been inserted tightly into the socket. However, with both manual insertion and automatic factory assembly in mind there are advantages to be gained from using multi-start threads. In particular, the steeper helix angle of a multi-start thread enables a spigot of any given length to be inserted into the socket with less rotation and, therefore, faster. Furthermore, a multi-start thread reduces the amount of rotation required on average to engage the thread when starting from a random orientation. Also, because a multi-start thread is deeper cut than a single start thread, the shear strength of the threads can be greater. A shorter spigot length is therefore possible.

There is a trend towards using ground-gripping elements of softer plastic materials. The durability of these cleats is considerably less. Therefore the golfer will need to replace cleats more frequently. Also, it is becoming common for golfers to have different sets of cleats for different conditions, so that cleats are changed as a result of assessing course conditions before play. When a single start thread system is used, cleat replacement can be a lengthy and laborious task, since the cleats require multiple turns for their removal and insertion. Since this is very often a manual operation many golfers are discouraged from replacing their cleats as often as they should.

Bayonet-type cleat fixings have been proposed as a way of overcoming the laboriousness of multiple-turn insertion and removal necessitated by conventional single-start screw thread fixings; by means of a bayonet-type coupling, connection or disconnection of the cleat from its holder can be achieved with only a very small rotation. However, in practice such quick-connect couplings have not been found to be entirely satisfactory. First, loadings acting to wrench the cleat from its holder in use can be very large. Whereas a screw-threaded coupling provides a relatively large and well-distributed area of load-bearing contact between the components, a bayonet-type coupling relies upon a very few points of contact which must carry all the load, and severe damage (e.g. involving shearing of the bayonet pins) can occur. Should such damage occur, removal of a damaged cleat may be difficult in cases where the failure has not been total and the cleat lost. Secondly, whilst the cleat may be designed to slide readily into and out of its holder, in practice its passage can become impaired, whether through distortion of the components or through the ingress of dirt, and operation of the system hampered.

For these various reasons, the use of a multi-start thread can be attractive. One example of use of a multi-start thread form is described in WO 91/04685, being in that case a two-start thread.

In order to ensure that a cleat does not become accidentally unscrewed (whether utilising a single start or multi-start thread) many forms of locking ratchet have been proposed. Many of these come into play only at the very end of insertion of the spigot into the socket. For example, a commonly proposed arrangement utilises interengageable sets of teeth in opposing annular arrays on surfaces perpendicular to the screw axis. Such an arrangement allows little latitude for variation in the depth of interengagement of the teeth, and correspondingly little latitude for variation of the depth of insertion of the spigot into the socket if the locking ratchet is to be properly engaged. Such variation can be important if the socket is provided in a composite shoe sole, since it is commonly not possible to guarantee during manufacture an exact level for the outer surface of the outsole relative to the socket.

Another form of locking ratchet, which can overcome that difficulty, is described in U.S. Pat. No. 5,036,606. In that construction, a ring of radially-projecting teeth on one component is disposed to engage with axially-extending splines arranged about a ring of the other component, the teeth riding over the splines (into spaces between the splines) as the two components are relatively rotated in insertion of the spigot into the socket. The axial extent of the splines provides for full co-operation of the teeth with the splines over a range of depths of insertion of the spigot into the socket. However, we have found that in this arrangement the teeth and/or the splines can become severely worn and the system becomes ineffective after several insertions and removals.

It is one of the objects of the present invention to provide an improved shoe cleat and holder combination which enables effective locking to be achieved over a range of depths of insertion of the spigot into the socket.

According to a first aspect of the invention, we provide a shoe cleat and holder combination in which a screw-threaded spigot of one of the two components is arranged to be inserted with rotation into a screw-threaded socket of the other component to secure the two components together and in which locking means of the components is arranged to become interengaged during insertion of the spigot into the socket in order to resist subsequent unscrewing of the assembly, the locking means comprising a ring of posts extending axially from one of the components and a ring of radially projecting teeth on the other component, the rings being co-axial with the screw axis, and during at least later stages of insertion of the spigot into the socket, on relative rotation of the rings, engagement of the teeth with the posts causes the posts to deflect resiliently and engagement of the teeth between the posts causes interengagement of the locking means.

The axial extent of the posts ensure that locking can be achieved over a range of depth of insertion, while the posts and teeth together form an effective locking means, with the resilience of the posts minimising the wear.

The number of teeth may be an integer multiple of the number of posts. The integer may be one, so that the number of teeth is the same as the number of posts.

As would be conventional the spigot can be provided on the cleat and the socket on the holder, but the opposite arrangement could be used.

Also, it is preferred that the ring of posts be provided on the cleat and the ring of teeth on the holder. Most preferably the teeth project from a cylindrical outer surface of a hub of the holder (forming the screw-threaded socket) and in use are received within the ring of posts, the hub being received into an annular well formed between the spigot and the posts.

Preferably the posts have a radially inner surface with a convex profile towards the ring of teeth, in order to smooth the passage of the teeth across surfaces of the posts between engagements of the teeth in recesses formed between the spaced posts. The circumferential ends of the surface may have different profiles to offer differing resistance to movement of the teeth past the posts on screwing and unscrewing. Preferably, the profiles are arranged to provide less resistance to screwing than unscrewing. This eases insertion, and helps to ensure that the cleat does not become unscrewed by mistake. The posts may be arranged in pairs, with each pair having a common base, or each post may be free-standing.

The screw thread of the spigot and socket may be a multi-start (most preferably three-start) thread, enabling rapid and efficient assembly of studs and holders. Most preferably the number of posts in the ring is a multiple of the number of thread starts, there being for example six, nine or twelve posts with a three-start thread.

The profile of the radially inner surface of the posts forms the subject of a further aspect of the invention.

According to a second aspect of the invention a shoe cleat has a screw-threaded spigot for rotary insertion into a socket of a holder to secure the cleat and holder together, and a ring of posts extending axially and adapted to engage with teeth of the holder, each post having a radially inner surface with a curved profile having a central convex region and first and second circumferential ends, the first and second ends having different profiles.

The differing profiles of the first and second circumferential ends means that the posts offer differing resistance to movement of the teeth past the posts on insertion and removal of the cleat from the holder.

Preferably the profiles are arranged so that the posts offer less resistance to the teeth for insertion of the cleat than they do for its removal. The circumferential end which is the leading end on insertion may have a concave profile facing the teeth, to facilitate passage of the teeth. The other circumferential end, that is, the leading end on removal, preferably has a convex profile towards the teeth, to resist unscrewing when not required.

If cleats are made out of different materials, the frictional and resilience characteristics of the posts will differ. The profiles of the circumferential ends can then be altered to ensure that each cleat requires approximately the same forces to be applied for insertion and removal, whatever material it is made of.

As with the first aspect of the invention, the posts may be free-standing, or arranged in pairs, with each pair having a common base. The screw thread of the spigot is preferably a multi-start thread, most preferably a three-start thread.

There now follows a detailed description to be read with reference to the accompanying drawings, of interengageable stud and socket-forming components which in their construction and in the manner of their inter-cooperation illustrate all the aspects of the invention by way of example.

Figure 1:
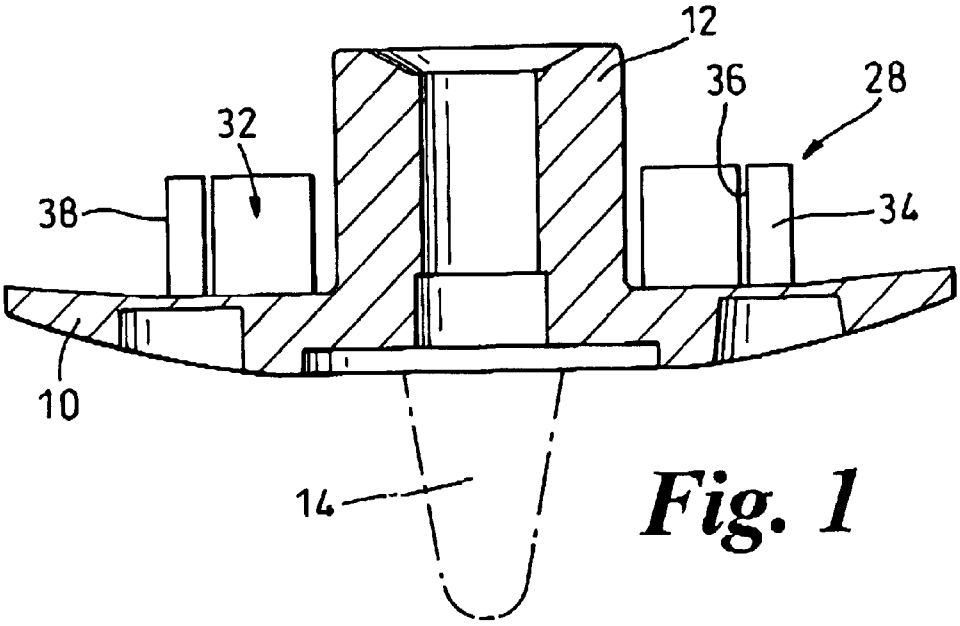
FIG. 1 is a sectional view of a stud seen in side elevation.
Figure 2:
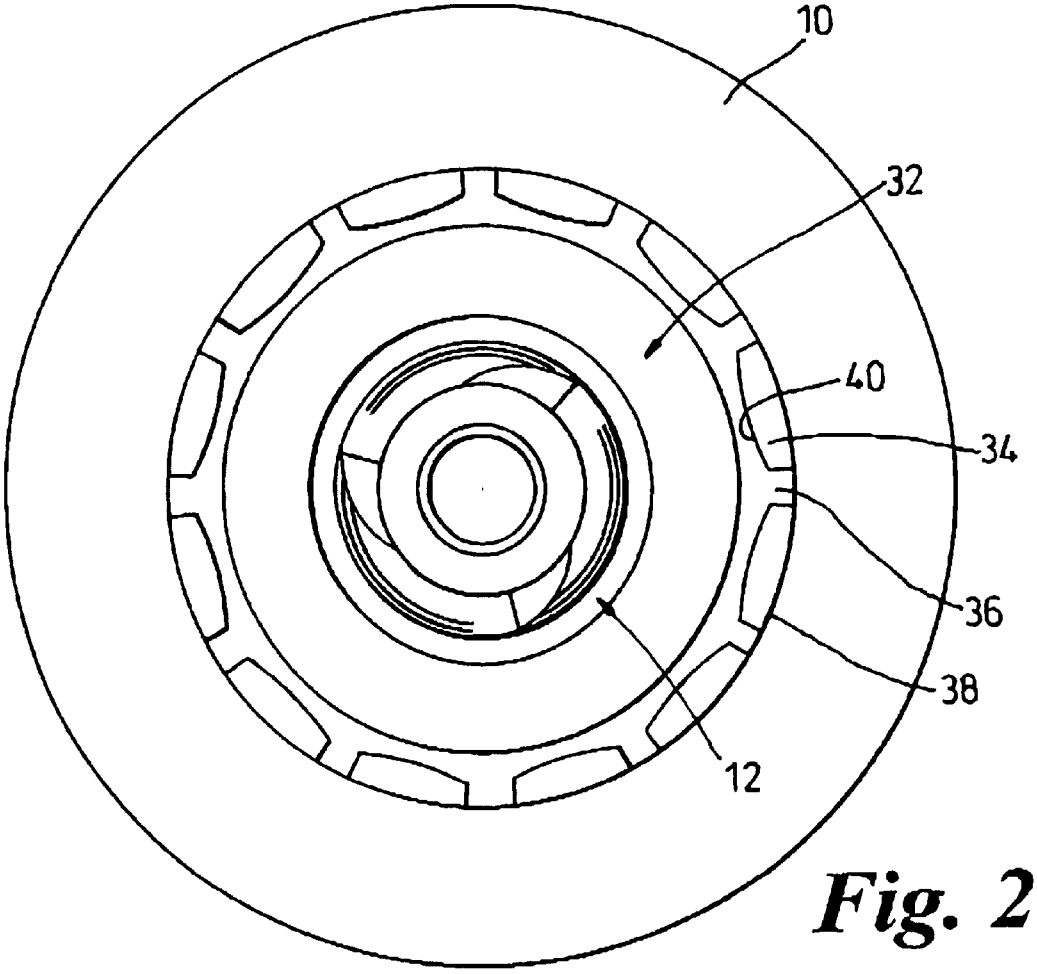
FIG. 2 is a plan view of the stud seen from above.

A shoe cleat in the form of a stud (FIGS. 1 and 2) suitable for use on a golf shoe has a disc-like flange 10. A screw-threaded spigot 12 projects from an upper side of the flange and a ground-engaging spike 14 projects from a lower side of the flange, the spigot and the spike being central on the flange. The flange and the spigot are formed by a unitary moulding of a plastics material, and the spike is formed by a metal pin which extends axially through the moulding and is secured in the moulding in the manner of a rivet.

Figure 3:
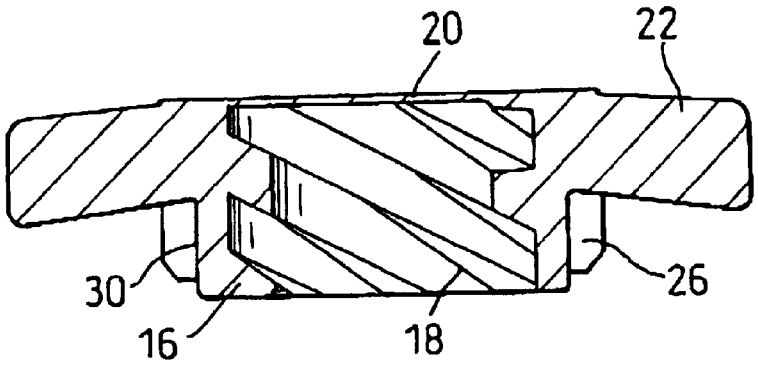
FIG. 3 is a sectional view of a receptacle (being a socket-forming component) seen in side elevation.
Figure 4:
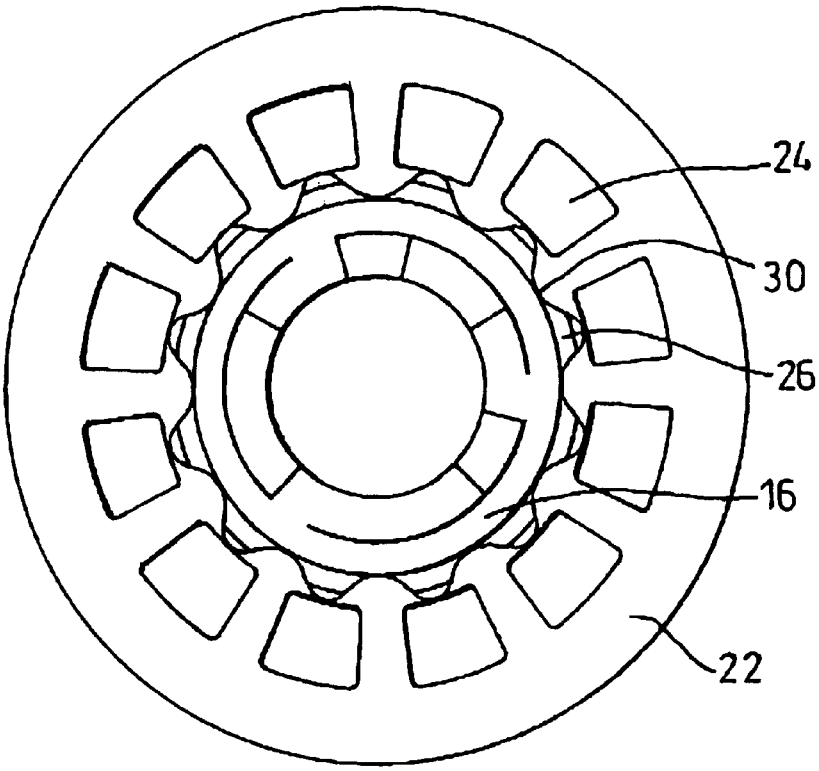
FIG. 4 is a plan view of the receptacle seen from beneath.

The stud is arranged for securement in a sole or heel of a golf shoe by means of a holder in the form of a socket-forming receptacle (FIGS. 3 and 4). The receptacle comprises a hub 16 having a screw-threaded socket bore 18, the bore of the hub being closed at its upper end 20. A flange 22 surrounds the hub, the flange being formed with perforations 24. For use the receptacle is incorporated into a moulded or composite outsole (or heel) of a golf shoe so as to present its screw-threaded bore 18 for reception of the complementarily threaded spigot 12 of the stud, so to secure the stud to the shoe. The receptacle is formed as a unitary moulding of a plastics material.

Such a stud and receptacle combination, as so far described, is well known in the art.

In the invention, the complementary thread forms of the stud and receptacle are three-start threads, providing a relatively steep helix angle which enables the stud to be inserted into the receptacle with a minimum of rotation. In order to secure the stud when screwed into the receptacle, the frictional resistance to unscrewing being relatively low owing to the steepness of the thread, a locking means is used. This comprises a ring of axially extending teeth 26 which are formed around the outside of the receptacle hub 16 to become engaged with inner surfaces of a collar 28 on the stud as the hub is inserted into the collar.

As seen in FIGS. 3 and 4, the teeth 26 project radially outwards from a cylindrical outer surface 30 of the hub, the teeth being in the form of short stubby ribs which extend in a direction parallel to the axis of the hub. In cross-section the ribs have a generally triangular form but present a rounded apex. The ribs are uniformly distributed co-axially about the hub axis, there being twelve ribs provided at 30° intervals.

The stud collar 28 (FIGS. 1 and 2) extends axially from the flange 10, being approximately half the height of the threaded spigot 12 which it surrounds coaxially. An annular well 32 is formed between the spigot 12 and the collar 28 for reception of the receptacle hub 16. The collar 28 comprises a ring of twelve separate segments forming free-standing posts 34 which are uniformly distributed at 30° intervals about the axis of the stud, the posts being separated by narrow slits 36. Radially outer surfaces 38 of the posts make up a cylindrical outer surface of the collar. Radially inner surfaces 40 of the posts (facing towards the teeth 26 in assembly) are slightly convex in planes perpendicular to the stud axis (FIG. 2) to present an inner surface of the collar which, interrupted by the slits 36, generally undulates in a circumferential direction about the stud axis.

The distance of radial projection of the teeth 26 from the receptacle axis is substantially equal to that of the inner surfaces of the posts 34 at circumferential positions immediately adjacent to the slits 36. That is to say, other than when the receptacle teeth 26 are radially aligned with the collar slits 36 there is radial interference between the teeth and the posts which causes frictional resistance to relative rotation of the components. Rotation of the stud relative to the receptacle is, therefore, resisted in steps by engagement of the teeth 26 with successive posts 34. This is the case whether the stud is fully inserted into the receptacle or only partially inserted (provided the degree of insertion is such that the teeth and the posts are interengaged).

The teeth 26 are substantially incompressible and reliance is placed on resilient deflection of the free-standing posts 34 to ease the passage of the teeth past the posts during relative rotation of the components. The convex surface profile of the posts 34 smoothes the passage of the teeth 26 across the surfaces of the posts between engagements of the teeth in the recesses formed between the spaced posts. As the spigot 12 is screwed into the socket, the posts 34 are less easily deflected, and so offer increasing resistance to passage of the teeth past them (as the teeth approach the bases of the posts at the flange 10) which serves to militate against any danger of overtightening the stud into the receptacle. Upon rotation of 120° of the spigot relative to the socket, after initial interengagement of the spigot and socket threads, the stud is fully inserted into the receptacle. In this position, the teeth 26 of the receptacle are in opposition to the slits 36 between the posts 34 of the stud collar.

The locking posts 34 on the stud physically deform outwardly as they pass over the locking teeth 26 on the receptacle and return into position when engaged into the recesses between the teeth. This physical movement is not dependent on the thread clearances and it is not affected by the thread geometry, permitting the two components of the thread assembly to be intimately coupled and thereby giving strength, resistance to stripping and easy location of the mating parts at assembly.

Figure 5:
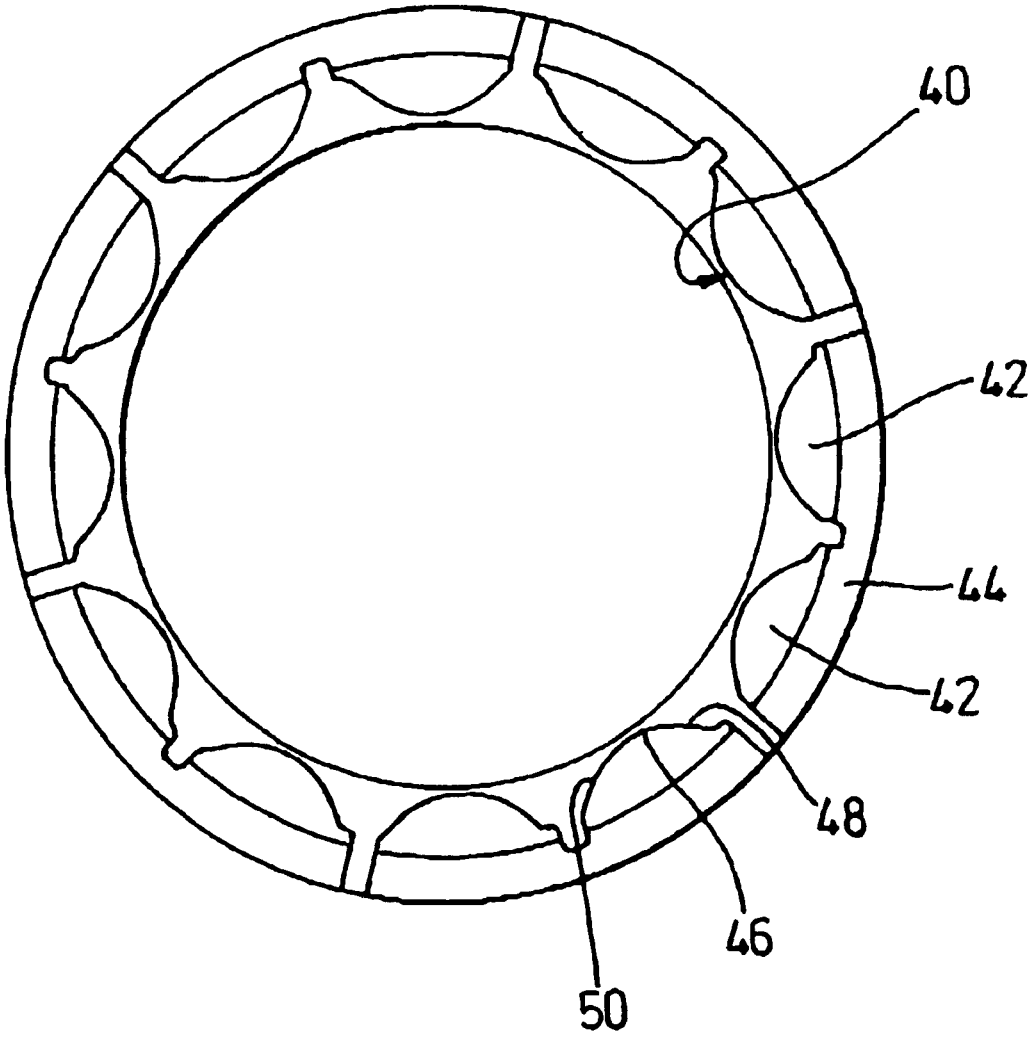
FIG. 5 is a view similar to FIG. 2, showing part of a further embodiment.

FIG. 5 shows a further embodiment of the collar 28 on the stud, and corresponding reference numerals have been applied to corresponding parts. Instead of the separate posts 34, in FIG. 5 posts 42 are in pairs, each pair sharing a common base 44. The radially inner surfaces 40 of each post 42 are also different. Although still generally convex towards the teeth, the circumferential ends of the surfaces are not mirror-symmetrical. Instead, each surface 40 has a central convex region 46, a first circumferential end 48 having a concave profile towards the teeth, and a second circumferential end 50 having a convex profile towards the teeth. The first end 48 is the leading end and the second end 50 is the trailing end when the stud is inserted in the holder, and vice versa when it is removed. The concave profile of the first end 48 presents less resistance to the teeth on insertion of the stud, while the convex profile of the second end 50 presents greater resistance on removal. This enables the stud to be inserted relatively easily, but prevents its accidental removal.

The profiles of the ends 48, 50 may be varied to vary the torque needed for screwing and unscrewing or to allow for different frictional and resilience characteristics of different materials.

I claim:

1. A shoe cleat having a screw-threaded spigot for rotary insertion into a socket of a holder to secure said cleat and holder together, wherein said cleat has a ring of free-standing posts extending axially and adapted to engage with teeth of the holder, each post having a radially inner surface with a curved profile having a central convex region and first and second circumferential ends, said first and second ends having different profiles.

2. A shoe cleat according to claim 1, wherein said profiles of said ends are arranged so that said posts offer less resistance to said teeth for insertion of said cleat into said holder than for its removal.

3. A shoe cleat according to claim 1, wherein said circumferential end which is the leading end on insertion has a concave profile facing said teeth.

4. A shoe cleat according to claim 1, wherein said circumferential end which is the leading end on removal has a convex profile facing said teeth.

5. A shoe cleat according to claim 1, whrein said posts are arranged in pairs, each pair having a common base.

6. A shoe cleat according to claim 1, wherein said screw thread of said spigot is a three-start thread.

* * * * *